US010226402B2

(12) United States Patent
Berkovitch

(10) Patent No.: US 10,226,402 B2
(45) Date of Patent: Mar. 12, 2019

(54) VENTED LIQUID CONTAINER

(71) Applicant: T.T.Y. GENERAL TRADE LINES LTD, Moshav Mesilat Zion (IL)

(72) Inventor: Amikam Berkovitch, Moshav Mesilat Zion (IL)

( * ) Notice: Subject to any disclaimer, the term of this patent is extended or adjusted under 35 U.S.C. 154(b) by 128 days.

(21) Appl. No.: 14/622,960

(22) Filed: Feb. 16, 2015

(65) Prior Publication Data

US 2015/0231035 A1 Aug. 20, 2015

Related U.S. Application Data

(60) Provisional application No. 61/940,440, filed on Feb. 16, 2014.

(51) Int. Cl.
*A61J 9/04* (2006.01)

(52) U.S. Cl.
CPC ..... *A61J 9/04* (2013.01)

(58) Field of Classification Search
CPC ... A61J 9/04; A61J 11/02; A61J 11/045; A61J 11/04; A61J 9/00
USPC .... 215/11.5, 11.1, 343, 260, 341, 11.2, 11.3, 215/11.4; 220/373, 378
See application file for complete search history.

(56) References Cited

U.S. PATENT DOCUMENTS 2,084,099 A * 6/1937 Maccoy ..... A61J 9/04 137/43
3,043,462 A * 7/1962 Brill, Jr. ..... A61J 9/008 215/11.1
3,200,980 A * 8/1965 Jamell ..... A61J 9/008 215/11.5
6,253,935 B1 * 7/2001 Fletcher ..... A61J 11/004 215/11.1
7,798,347 B2 9/2010 Rees
8,763,828 B2 * 7/2014 Dunn ..... A61J 9/04 215/11.5
2008/0173612 A1 * 7/2008 Renz ..... A61J 9/04 215/260

(Continued)

FOREIGN PATENT DOCUMENTS

GB 2323838 A 10/1998
WO 9818427 A1 5/1998
WO 2013033487 A1 3/2013

*Primary Examiner* — Fenn C Mathew
*Assistant Examiner* — Cynthia Collado
(74) *Attorney, Agent, or Firm* — Deborah A. Gador

(57) ABSTRACT

A vent system for a liquid container having a container body with a top dispensing opening and a bottom portion having coupling elements and a bottom opening, the vent system including a solid closure member for closing the bottom opening; a sealing member disposed in the closure member, the sealing member including a sealing element configured to seal a rim of the container bottom opening and having a bore, and a one-way valve sealing the bore against liquid passage from the container and selectively permitting air passage through the bore into the container; complementary coupling elements on the closure member for coupling to the coupling elements on the bottom portion of the container, configured so that ambient air can enter between the container body and the closure member; and an air conduit extending from the coupling elements to a space in the vent system which is in operative communication with the bore, and a method for making it.

14 Claims, 8 Drawing Sheets

(56) References Cited

U.S. PATENT DOCUMENTS

2015/0290086 A1* 10/2015 Prentice ..... A61J 9/04
215/11.5

* cited by examiner

VENTED LIQUID CONTAINER

RELATED APPLICATIONS

The present application claims the benefit of U.S. Provisional Patent Application No. 61/940,440, filed on 16 Feb. 2014. The disclosure of the prior application is considered part of and is incorporated by reference in the disclosure of this application.

FIELD OF THE INVENTION

The present invention relates to vented liquid containers, in general and, in particular, to a vent system for liquid containers, especially baby bottles.

BACKGROUND OF THE INVENTION

Specialized baby bottles are manufactured with features that are designed to attempt to reduce colic symptoms in infants drinking from the bottles, particularly from zero months to approximately four months. Typically, a vent insert used in conjunction with the bottle top provides a passage for air from the exterior of the bottle to the interior of the bottle. In these bottles, bubbles of air travel through the drinking liquid or an anti-bubble tube must be provided in order to transfer the air from the top of the bottle to the bottom of the bottle (which is higher than the top while the baby is drinking). These top vent systems have dispensing openings for the passage of liquid therethrough for dispensing.

For ease of internal cleaning and in order to eliminate the necessity for an anti-bubble tube, various bottles were developed having bottom openings to permit the inflow of air therethrough during drinking. One such baby bottle is shown in U.S. Pat. No. 3,134,495. This bottle includes two nipples and two threaded retainers, one mounted outside the top opening for dispensing and the second mounted inside the bottom opening for venting. Both threaded retainers have apertures in the middle to permit the outflow of liquid and the inflow of air, respectively. This bottom air receiving aperture, while it can be small, can result in dirt entering into the bottle together with the ambient air and the aperture can be difficult to clean to prevent clogging.

Another such baby bottle is shown in U.S. Pat. No. 5,499,729. This bottle includes a diaphragm member disposed in the bottom opening and covered by a cap with a central hole. The diaphragm member is gas and liquid tight when the inside and outside pressures on the bottle are equal and the bottle is in an upright configuration with the feeding liquid resting on the diaphragm member. The diaphragm member has a central portion which is dome shaped and provided with apertures that are in a sealed shut configuration when the diaphragm member is relaxed yet that are opened directly to the outside of the bottle when the diaphragm member is expanded responsive to differential air pressure. This type of exposed arrangement can result in dirt and germs collecting on the diaphragm and, during use, entering into the bottle together with the ambient air. In addition, bottom holes can result in clogged air inlet apertures.

Unlike conventional top vent systems, openings for passage of liquid for dispensing are not relevant for bottom venting systems.

Accordingly, there is a long felt need for a baby bottle having a vent system that does not require holes in the bottom closure of the bottle for the ingress of ambient air, so is less susceptible to the entry of dirt together with the ambient air, and it would be desirable to have a practical vent system that can be used to seal and vent the bottom of any liquid container for dispensing a liquid that has a bottom opening and that does not require holes in the bottom closure.

SUMMARY OF THE INVENTION

The present invention relates to a liquid container having a bottom opening for receiving a vent system, wherein the air inlet of the vent system does not require a hole in the bottom of the container. Rather, the ambient air enters the container between complementary portions of the container and the vent system, through an air conduit, which can be air vent channels defined between a sealing member and a bottom closure member, and through a one-way valve in the sealing member disposed inside the container. This structure does not require a hole in the bottom cover of the container, so the container is less susceptible to dirt and germs coming into the container with the air.

There is provided, according to the present invention, a vent system for a liquid container having a container body with a top dispensing opening and a bottom portion having coupling elements and a bottom opening, the vent system including a solid closure member for closing the bottom opening, a sealing member disposed in the closure member, the sealing member including a sealing element configured to seal a rim of the container bottom opening and having a bore, and a one-way valve sealing the bore against liquid passage from the container and selectively permitting air passage through the bore into the container; complementary coupling elements on the closure member for coupling to the coupling elements on the bottom portion of the container, configured so that ambient air can enter between the container body and the closure member; and an air conduit extending from the coupling elements to a space in the vent system which is in operative communication with the bore.

There is also provided, according to the invention, a vented liquid container including a container body with a top opening and a bottom portion having coupling elements and a bottom opening; and a vent system for closing and sealing the bottom opening, the vent system including: a solid closure member for closing the bottom opening; a sealing member disposed in the closure member, the sealing member including a sealing element configured to seal a rim of the container bottom opening and having a bore, and a one-way valve sealing the bore against liquid passage from the container and selectively permitting air passage through the bore into the container; complementary coupling elements on the closure member for coupling to the coupling elements on the bottom portion of the container, configured so that ambient air can enter between the container body and the closure member; and an air conduit extending from the coupling elements to a space in the vent system which is in operative communication with the bore.

Further according to the present invention, there is provided a method for making a vent system for a liquid container having a container body with a top dispensing opening and a bottom portion having coupling elements and a bottom opening, the method including providing a solid closure member for closing the bottom opening; disposing in the solid closure member a sealing member including a sealing element configured to seal a rim of the container bottom opening and having a bore, and a one-way valve sealing the bore against liquid passage from the container and selectively permitting air passage through the bore into the container; providing complementary coupling elements on the closure member for coupling to the coupling elements on the bottom portion of the container, the coupling elements and complementary coupling elements configured so that ambient air can enter between the container body and the closure member; and defining an air conduit extending from the coupling elements to a space in the vent system which is in operative communication with the bore.

Additionally according to the present invention, there is provided a method for making a vented drinking container, the method including providing a container body with a top opening and a bottom portion having coupling elements and a bottom opening; providing a solid closure member for closing the bottom opening; disposing in the solid closure member a sealing member including a sealing element configured to seal a rim of the container bottom opening and having a bore, and a one-way valve sealing the bore against liquid passage from the container and selectively permitting air passage through the bore into the container; providing complementary coupling elements on the closure member for coupling to the coupling elements on the bottom portion of the container, the coupling elements and complementary coupling elements configured so that ambient air can enter between the container body and the closure member; defining an air conduit extending from the coupling elements to a space in the vent system which is in operative communication with the bore; and coupling the vent system to the container body.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1A:
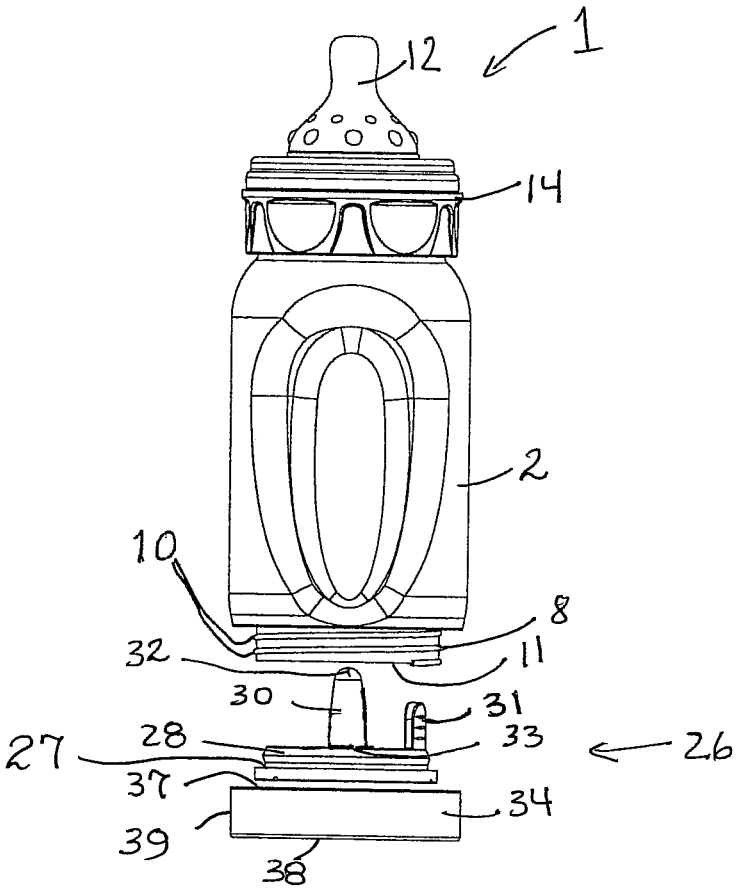
FIG. 1*a* is a plan view of a liquid container according to some embodiments of the invention in an open orientation.

The present invention relates to a vented liquid container for providing entry of ambient air into the container to release the vacuum formed when contents of the container are removed, as by drinking. One particularly suitable implementation of the liquid container is a vented baby bottle with features that are designed to reduce colic symptoms and reduce ear infections in infants. A vent system disposed in the bottom of the container provides a passage for air from the exterior of the container to the interior of the container during drinking and, at the same time, prevents leakage of liquid from the container through the air passage. More specifically, the liquid container has an open ended body, having a top opening and a bottom opening, with the vent system disposed in the bottom opening. The vent system removably connects to the bottom opening of the container, and includes a one-way valve that allows air to enter the container when a vacuum is formed inside the container, but does not allow liquid to exit the container via the vent system. The valve is integrally formed with or is coupled to a sealing element, thereby forming a sealing member which completely seals the bottom opening of the container. The valve covers and selectively and reversibly seals a bore formed through the sealing element.

A solid closure member holds the sealing member and serves as the bottom wall of the container body. It closes the bottom of the container in such a way that the sealing member completely seals the rim of the bottom opening of the container. The sealing element is sized and shaped to close and seal the entire bottom opening of the container and at least a part of the bottom rim when pressed by the closure member against the rim of the container, but for a bore through the sealing member for passage of air that is selectively sealed by a one-way valve. The closure member is designed so that, when the closure member is tightly closed on the container, ambient air can enter the container between coupling elements on the closure member and complementary coupling elements on the container body.

For purposes of the present invention, "solid" means without a break or opening. Thus, the closure member is solid and has no holes in its bottom wall.

At least one air conduit is provided extending from the coupling elements to the a space in operational communication with the bore. The air conduit can be an air conduit created between vent grooves defined in the sealing element and a surface of the closure member, or between vent grooves defined in the closure member and a surface of the sealing element, or a tubular conduit through the sealing element, or a tubular conduit through the closure member. The air conduits extend at least part way from the coupling elements at the periphery of the sealing member to a space in operational communication with the bore in the sealing element. This space is defined by the inner surface of the bottom wall of the closure member and the inner walls of the valve. The air conduits are also in operational communication with the coupling elements on the closure member and the container body, and with the one way-valve. In this way, when liquid is removed from the container, such as when a baby drinks from the bottle, and a vacuum is formed in the container, ambient air enters the liquid container through the air passage between the complementary elements, through the air conduit to the space, through the valve and into the container body.

It will be appreciated that the air conduits are sealed from the liquid in the container by the one-way valve, so that liquid inside the container body is prevented from flowing out of the container through the air conduits.

In some embodiments, the closure member is arranged to hold the sealing member even when the closure member is disengaged and removed from the liquid container. This allows the sealing member to be removed together with the closure member, instead of remaining in the bottom opening. This can be accomplished, for example, by providing a stop element on the closure member which serves to retain the sealing member within the closure member. Preferably, the stop element is integrally formed or molded with the closure member. In this case, a pull tab can be provided on the sealing member for ease of disengagement of the sealing member from the closure member.

Figure 1B:
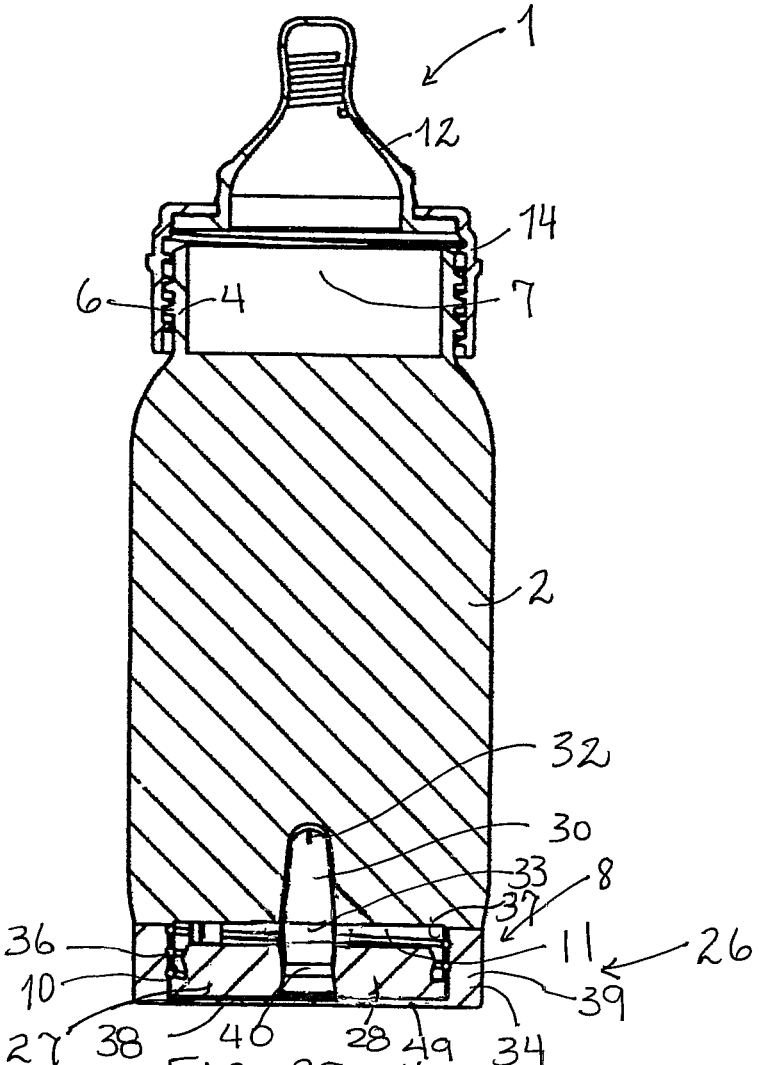
FIG. 1*b* is a sectional view of the liquid container of FIG. 1*a* in a closed orientation.

Referring now to the drawings, FIG. 1*a* is a plan view of a liquid container 1, here illustrated, for purposes of non-limiting example only, as a baby bottle, according to some embodiments of the invention, in an open orientation, and FIG. 1*b* is a sectional view of the baby bottle of FIG. 1*a* in a closed orientation. Baby bottle 1 has an open ended body 2 with a top opening 7 and a bottom opening 11. An open ended body provides easy access from both ends of the bottle to its interior, which is especially useful during cleaning. A top neck 4 with external screw threads 6 is formed near the top opening 7, as known, to receive a conventional nipple or teat 12 and collar 14. A bottom portion 8 having a coupling element 10, here illustrated as external screw threads, is formed near the bottom opening 11. A solid closure member 34, having a complementary coupling element 36, here illustrated as internal screw threads, is provided to close bottom opening 11 of bottle 1. It will be appreciated that, alternatively, the coupling elements can include external screw threads on the closure member and internal screw threads on the bottom portion of the bottle. Alternative coupling elements, such as a snap fit arrangement, are also effective as long as they tightly hold the closure member in place while permitting ambient air to enter from outside the bottle, between the coupling element and the complementary coupling element, and into the bottle. In this embodiment, closure element 34 has a flat bottom wall 38 and side walls 39.

Bottle 1 further includes a vent system 26 to permit the inflow of ambient air into the body 2 when vacuum is formed in the bottle during drinking, so as to release the vacuum. Vent system 26 includes the closure member 34 and a sealing member 28, including a one-way valve 30 and a sealing element 27, illustrated in this embodiment as a flat disk. A bore 40 is formed through sealing element 27 to permit the passage of air into the container, as described below. Bore 40 is closed against the ingress of liquid by valve 30. Sealing element 27 completely seals the bottom opening and has only a bore for air passage therethrough.

Figure 2:
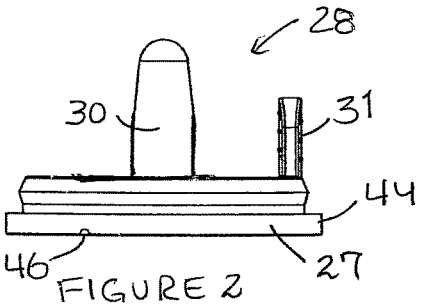
FIG. 2 is a plan view of a sealing member in a vent system according to some embodiments of the present invention.
Figure 3:
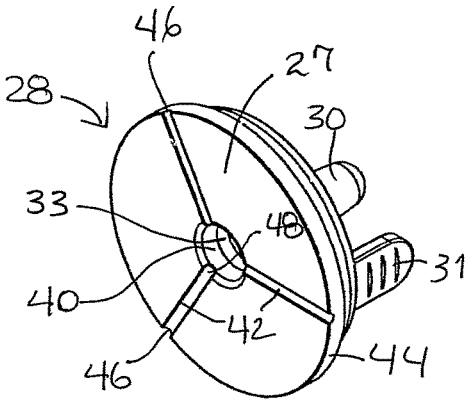
FIG. 3 is a bottom perspective view of the sealing member of FIG. 2.
Figure 4:
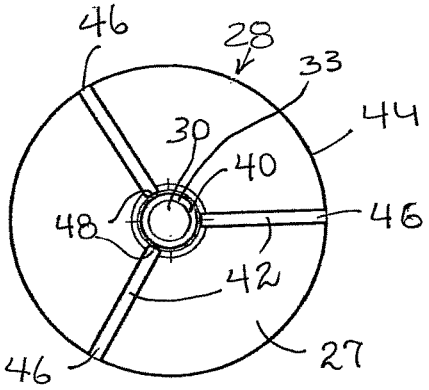
FIG. 4 is a bottom view of the sealing member of FIG. 2.

A sealing member according to some embodiments of the invention is shown in FIGS. 2 to 4. Preferably, valve 30 is integrally formed with sealing element 27 such that the sealing member is a single part. Alternatively, sealing element 27 can be a sealing disk and valve 30 can be formed separately and sealingly engage the sealing disk. Preferably, sealing element 27 and valve 30 are formed of a flexible material, such as a silicone material.

Valve 30 is a one-way valve that includes a first valve opening 32, illustrated in this embodiment as a top slit, for selectively introducing air into the bottle body 2 but blocking the passage of liquid from the inside to the outside of the bottle. Alternatively, any other valve can be utilized that has the characteristics of a pressure-responsive valve, meaning that the slit will remain closed when the pressure inside the bottle is the same as atmospheric pressure, but will open to admit air when removal of the bottle contents reduces its internal pressure below atmospheric pressure, thereby creating a vacuum.

Valve 30 has a second opening 33 that communicates with bore 40 formed through sealing element 27. Sealing element 27 further includes at least one, and preferably a plurality of vent grooves 42 (best seen in FIGS. 3 and 4), here illustrated as open grooves formed in the flexible sealing element 27, preferably in the surface of the sealing element facing the closure member. Vent grooves 42 extend from the periphery 44 of the sealing member 28 at least part way to bore 40, and have an opening 46 at the periphery of the sealing member, and an opening 48 to a space in operational communication with bore 40. This space is defined by the inner surface of the bottom wall of closure member 34 and the inner walls of the valve 30. Valve 30 is shown here in the center of the sealing member 28 but that is not required as long as the grooves 42 provide an air passage in communication with the bore 40, wherever it is located on the sealing member 28. As described below, according to some embodiments, the grooves 42 extend from the periphery only part way to the bore, to the space in operational communication with the bore.

As can be seen in FIG. 1*b*, sealing member 28 sits inside the closure member 34. Closure member 34 has a top opening 37 for receiving the sealing member 28. Sealing member 28 is disposed on the flat bottom wall 38 of closure member 34 and is pressed by the closure member against the rim of bottom opening 11 of the bottle 1 to seal the bottom opening 11. It will be appreciated that the diameter of the sealing element is wider than the diameter at least of the inner walls of the rim on the bottom opening of the bottle body, so as to provide a liquid seal for the bottom of the bottle. Closure element 34 is preferably formed of a material that is rigid relative to the sealing element 27. When the vent system 26 is assembled on the bottle, the valve 30 protrudes into the bottle 1 and ambient air can enter the interior of the bottle through bore 40 and valve 30.

It will be appreciated that the shape of the sealing member conforms to the shape of the closure member, at least partially. At least a sealing lip or other sealing portion conforms to the closure member to permit proper sealing of the bottom bottle opening. The remainder of the shape of the sealing member and of the closure member is a matter of design choice. When the shape of the sealing member is complementary to the shape of the closure member, the sealing member tends to cling to the closure member. A tab 31 may be provided on sealing member 28 for aid in removal of the sealing member from closure member 34.

In this embodiment, air conduits 49 are formed by placing the bottom of sealing member 28 in sealing engagement with the inner surface of the bottom wall 38 of the closure element 34. In this way, the bottom wall 38 closes and seals the open grooves 42 in the sealing element to form closed air conduits 49. Alternatively, any other air conduit through or around the sealing element 27, providing operational communication from the periphery of the sealing member to the bore, can be used instead of open grooves. For example, the air conduits can be tubular channels extending through the sealing element 27, or can be formed by open grooves in the closure member which are closed and sealed by the bottom surface of the sealing element. It will be appreciated that, while the vent grooves 42 are covered and sealed by wall 38, the ends 46 and 48 of vent grooves 42 remain open and serve as air conduit openings. These air conduit openings are on the periphery 44 of the sealing element 27 and are in flow communication with the space between the coupling elements on the closure member and the bottle, in this example, between the threads 36 of the closure element 34 and the threads 10 on the exterior of the bottle 1. The air conduit openings permit air flow from the air conduit directly or indirectly into bore 40 and valve 30.

Removal of the sealing member 28 from the closure member 34 can be accomplished, for example, by pulling tab 31. Sealing member 28 is typically flexible, formed from a flexible material such as silicone, so that it is stable enough to give it a shape, but flexible enough to be bent and twisted to a certain degree, to pass the stop element. In some embodiments, the screw threads on the closure member may extend far enough that they act as a stop member.

If it is desired to permit greater air inflow, air inlet channels can be formed in the threads 36, as by forming aligned notches (not shown) in the threads. Preferably, an arrangement, such as one or more guides, is provided to retain the notches in registration with the openings 46 in the grooves 42.

It will be appreciated that since air vent grooves are provided in the sealing element in cooperation with a flat closure member in the present embodiments operationally coupled to the space between the coupling members, no exposed holes are required in the bottom of the closure member in order to permit ambient air to enter the bottle.

The method of operation of the devices of the embodiments of FIGS. 1-4 of the present invention is as follows. In order to bring air into the baby bottle 1, the sealing member 28 is disposed in the closure member 34, creating at least one air conduit from the periphery of the sealing member 28 to the bore 40, in this case, between the vent grooves 42 in the sealing element and a surface of the closure member. Thus, in these embodiments, the air conduits extend from the periphery of the sealing element to the bore in the sealing element, and are in operational communication with the coupling elements and with the one way-valve coupled to the sealing element and selectively closing the bore. The closure member 34 is then coupled, via the coupling element 10 on the bottle and the complementary coupling element 36 of the closure member 34, to bottom opening 11 in the lower portion of the bottle body, causing the sealing element to sealingly engage the bottom opening 11 of the bottle. Then, when suction creates a vacuum inside the bottle, ambient air from outside of the bottle passes between the coupling elements between the closure member and the bottle body into the air conduit in the vent system. This air flows into the conduit openings 46, via the air vent channels 42, through conduit openings 48 and bore 40 to the valve 30, and through the one-way opening or slit 32 of the valve 30 to the interior of the bottle 1. It will be appreciated that, since air conduits permit the passage of ambient air from the screw threads of the closure member through the sealing member and into the bottle, this structure avoids the need for holes through the bottom closure member.

Figure 5:
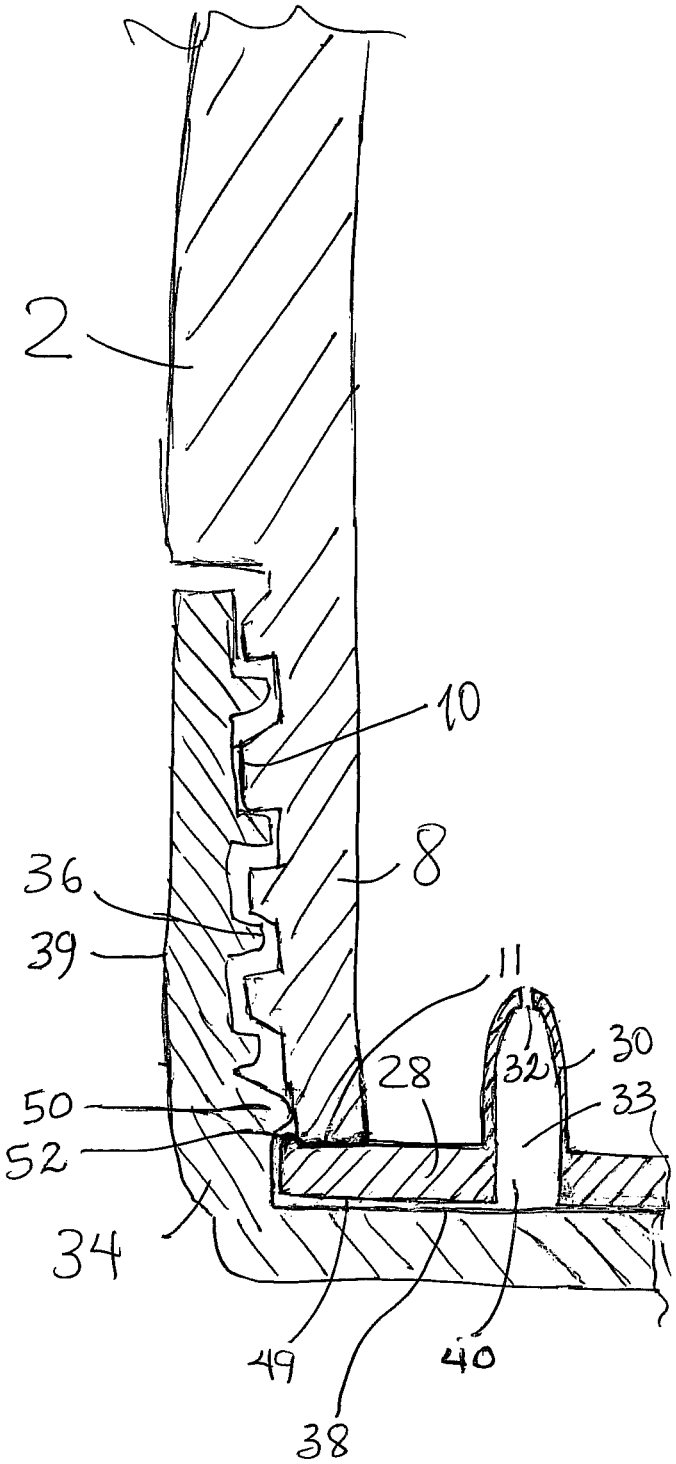
FIG. 5 is a sectional detail view of a portion of a liquid container according to some embodiments of the invention, in a closed orientation.

In some embodiments, a stop element is provided to releasably retain the sealing member in the closure member. FIG. 5 is a sectional detail view of a portion of a liquid container according to some embodiments of the invention, showing one example of a stop element. In FIG. 5, a stop element 50 is shown formed on an inside surface of the closure member 34. Stop element 50 is placed below screw threads 36, in proximity to bottom surface 38, and extends and protrudes towards the center of the closure member 34. If desired, the sealing member may have a larger diameter than the outer walls of the lower portion of the container body so as to engage the stop element 50, retaining the sealing element inside the closure member. Alternatively, a protrusion 52 may be provided on the sealing element 27 which engages stop element 50 of closure member 34 as by snap fit. Stop element 50 serves to prevent the sealing member 28 from falling out of the closure member 34 inadvertently, even when the closure member 34 is unscrewed and removed from the liquid container. Such an arrangement enables a user to easily disassemble the container for cleaning, and to refill and reassemble the container, while the sealing element is securely retained in the closure member.

Figure 6A:
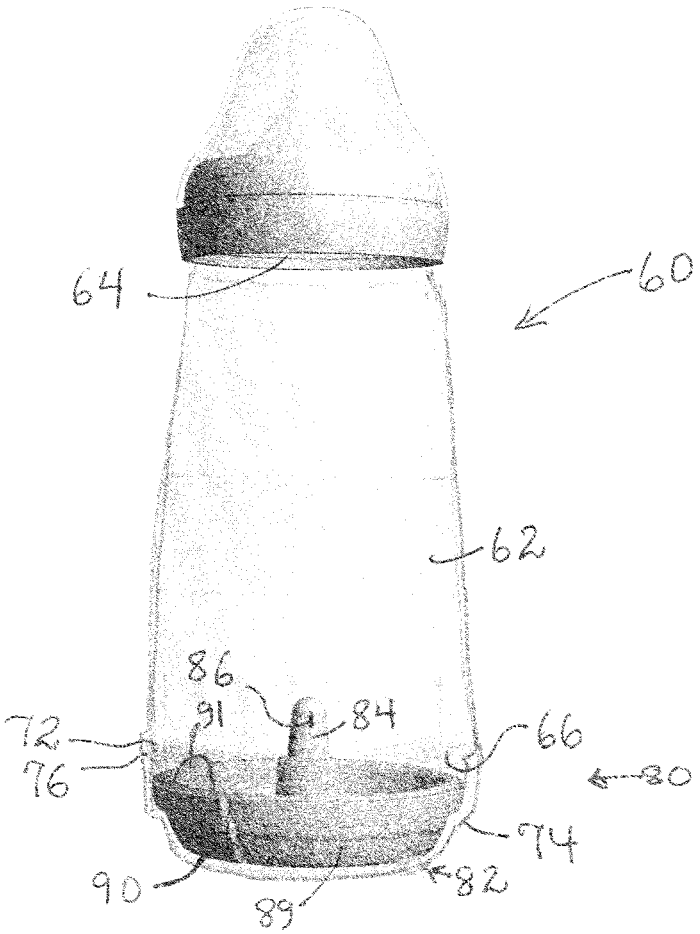
FIG. 6*a* is a plan view of a liquid container according to alternative embodiments of the invention.
Figure 6B:
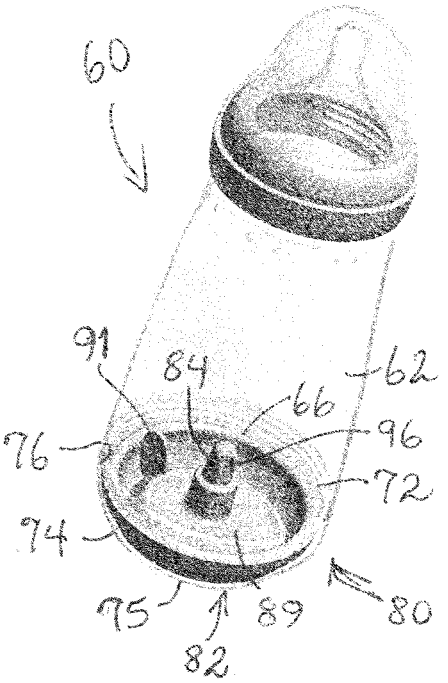
FIG. 6*b* is a perspective view from the top of the liquid container of FIG. 6*a;*
Figure 6C:
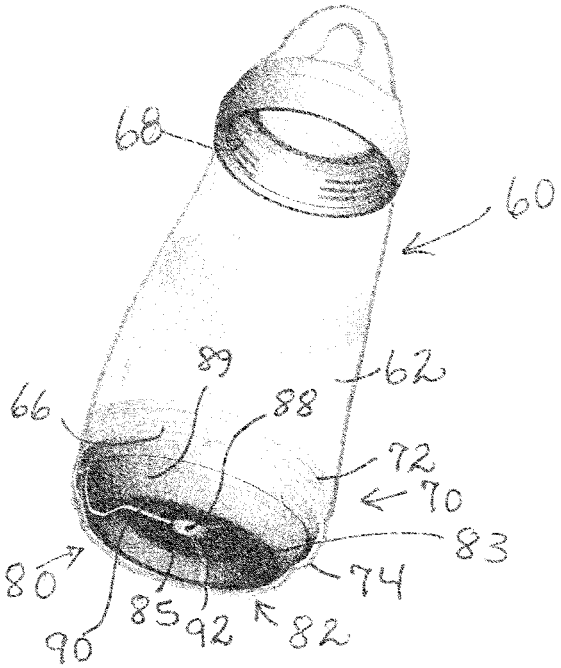
FIG. 6*c* is a perspective view from the bottom of the liquid container of FIG. 6*a;*
Figure 6D:
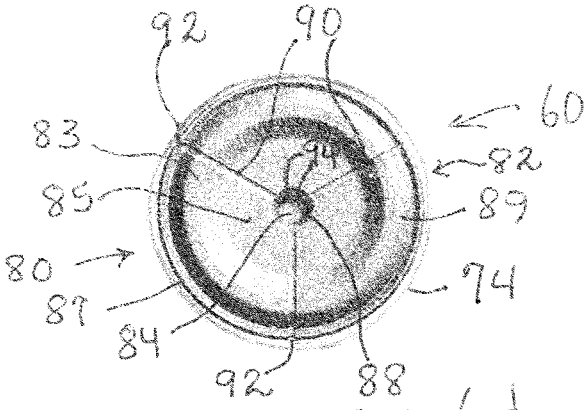
FIG. 6*d* is a bottom view of the liquid container of FIG. 6*a;*

FIG. 6*a* is a plan view of a liquid container 60, here illustrated for purposes of non-limiting example only, as a baby bottle, according to alternative embodiments of the invention. FIGS. 6*b* and 6*c* are perspective views of baby bottle 60 and FIG. 6*d* is a bottom view of baby bottle 60. Baby bottle 60 has an open ended body 62 with a top opening 64 and a bottom opening 66 and is transparent in the illustration. A top neck 68 with external screw threads is formed near the top opening 64, as known, to receive a conventional nipple or teat and collar. A bottom portion 70 having a coupling element 72, here illustrated as external screw threads, is formed near the bottom opening 66. A solid closure member 74, having a coupling element 76 complementary to coupling element 72, here illustrated as internal screw threads, is provided to close bottom opening 66. Closure member 74 is illustrated here as being transparent. As described above with reference to coupling elements 10 and 36, coupling element 72 and complementary coupling element 76 are configured to permit ambient air from outside the bottle to pass between them into the closure member 74 when the bottle is assembled. It will be appreciated that, instead of screw threads, any other suitable coupling element can be provided for providing engagement between bottom portion 70 of bottle 60 and closure member 74, as long as it permits ambient air to enter between them into the closure member.

Figure 7A:
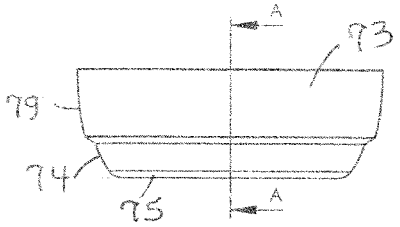
FIGS. 7*a* and 7*b* are plan and sectional views, respectively, of a closure member of the liquid container according to FIG. 6*a;*
Figure 7B:
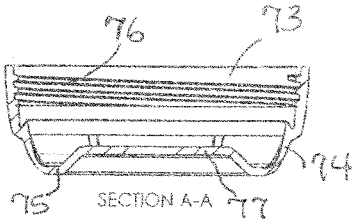

In this embodiment, closure member 74 has an annular u-shaped bottom wall 75 with a raised, flat portion 77 in the center and a peripheral channel 79. This can be seen most clearly in FIGS. 7*a* and 7*b* in plan and sectional views, respectively. Alternatively, any other suitable shape of closure member can be utilized. Closure member 74 has a top opening 73 and a bottom wall 75 designed to receive and support sealing element 89. Sealing element 89 is disposed on the bottom wall 75 of closure member 74. The complementary portions of the sealing element are pressed by the bottom wall and the annular channel of the closure member against the rim of bottom opening 66 of the bottle to seal the bottom opening 66 of the bottle 60. Closure member 74 is preferably formed of a material that is rigid, relative to the sealing element 89. When the bottle is assembled, the valve 84 protrudes into the bottle and ambient air can enter the interior of the bottle through bore 88. A tab 91 is preferably provided on sealing member 82 for aid in removal of the sealing member from closure member 74.

Bottle 60 further includes a vent system 80 to permit the inflow of ambient air from the closure member 74 into the body 62 when vacuum is formed in the bottle during drinking, so as to release the vacuum. Vent system 80 includes the closure member 74 and a sealing member 82, including a sealing element 89 with a through-going bore 88 selectively sealed by a one-way valve 84. Bore 88 permits the passage of air into the container from the closure member, as described below. Valve 84 is a one-way valve that closes bore 88 against the ingress of liquid and includes a first valve opening 86, illustrated in this embodiment as a side slit, for selectively introducing air into the bottle body 62 but blocking the passage of liquid outwards from the inside of the bottle. Alternatively, any other valve can be utilized that has the characteristics of a pressure-responsive valve, meaning that the slit will remain closed when the pressure inside the bottle is the same as atmospheric pressure, but will open to admit air when removal of the bottle contents reduces its internal pressure below atmospheric pressure, thereby creating a vacuum. Preferably, valve 84 is integrally formed with sealing element 89. Alternatively, valve 84 can be formed separately and sealingly engage sealing element 89. Preferably sealing element 89 and valve 84 are formed of a flexible material, such as a silicone material. When the bottle is assembled, the valve 84 protrudes into the bottle 60. Valve 84 has a second opening 87 that communicates with a bore 88 formed through sealing element 89.

Figure 8A:
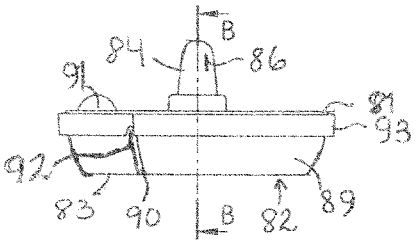
FIGS. 8*a* and 8*b* are plan and sectional views, respectively, of a sealing member of the liquid container according to FIG. 6*a;*
Figure 8B:
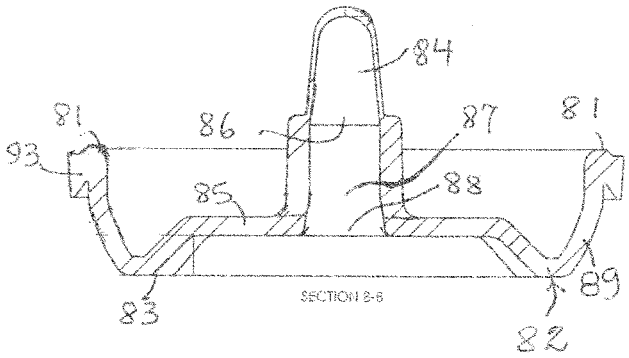

A sealing member 82, according to some embodiments of the invention, complementary in shape to the closure member, is shown in FIGS. 8*a* and 8*b*, in plan and sectional views, respectively. The shape of the sealing member is complementary to the shape of the closure member in this embodiment, so as to form air conduits there-between. Sealing element 89 is illustrated in this embodiment as having an annular U-shaped portion 83 with a raised central flat portion 85 defining a through-going bore 88, and a peripheral sealing lip 81 for sealing the bottom opening of the bottle. It will be appreciated that the diameter of the peripheral sealing lip 81 is wider at least than the inner walls of the rim of the bottle body so as to provide a liquid seal for the bottom of the bottle. Sealing element 89 further includes at least one, and preferably a plurality of vent grooves 90, open grooves formed in the flexible sealing element 89, preferably in the surface of the sealing element facing the closure member. Vent grooves 90 extend from the periphery 93 of the sealing element 89 (i.e., from the bottom of the sealing lip 81) to bore 88, and have an opening 92, 94 at each end. This can best be seen in FIGS. 6*c* and 6*d*. Valve 84 is shown here in the center of the sealing element 89 but that is not required as long as grooves 90 extend from the periphery 87 to the bore 88, wherever it is located on the sealing element 89.

At least one air conduit is formed by placing the bottom of sealing element 89 in sealing engagement with the inner surface of the bottom wall 75 of the closure element 74. In this position, bottom wall 75 closes and seals the open grooves 90 and forms closed air conduits. While the vent grooves 90 are covered and sealed by bottom wall 75, the open ends 92 and 94 of vent grooves 90 remain open and serve as air conduit openings. Openings 92 open at the periphery 87 of the sealing element 89 and are in communication with the space between the coupling element 72 of the bottle and the complementary coupling element 76 of closure element 74. Openings 92 permit air flow into bore 88 and are in flow communication with valve 84.

It will be appreciated that, alternatively, the vent grooves can be formed in the bottom of the closure member, rather than in the sealing member 82, closed by the bottom surface of the sealing member, and operationally coupled to the valve. Alternatively, the air conduit can be a tubular channel formed through the sealing element or through the closure member.

In this embodiment, as well, a stop element (not shown) may be provided to releasably retain the sealing element in the closure member. Removal of the sealing member 82 from the closure member 74 can be accomplished, for example, by pulling tab 91. Sealing member 82 is typically flexible, formed from a flexible material such as silicone, so that it is stable enough to give it a shape, but flexible enough to be bent and twisted to a certain degree, to pass the stop element.

Operation of bottle 60 is substantially as described above with regard to bottle 1. Thus, the sealing member 82 is disposed in the closure member 74, creating at least one air conduit between the groove 90 in the sealing element and the inner surface of the bottom wall of the closure member. The closure member 74 is then coupled, via the coupling element 72 on the bottle and the complementary coupling element 76 of the closure member 74, to the bottom opening in a lower portion of the bottle body, causing the sealing element to sealingly engage the rim of the bottom opening 66 of the bottle. In this embodiment, the air conduits extend from the periphery 93 of the sealing element (e.g., from the bottom of the sealing lip 81) to the bore 88 in the sealing element, which operationally communicates with the coupling elements and with the one way-valve. Thus, when suction creates a vacuum inside the bottle, ambient air from outside of the bottle passes between the coupling elements between the closure member and the bottle body into the air conduits. This air flows into the conduit openings 92, via the air conduits, through conduit openings 96 and bore 88 to the valve 84, and through the one-way opening or slit of the valve 84 to the interior of the bottle.

Figure 9A:
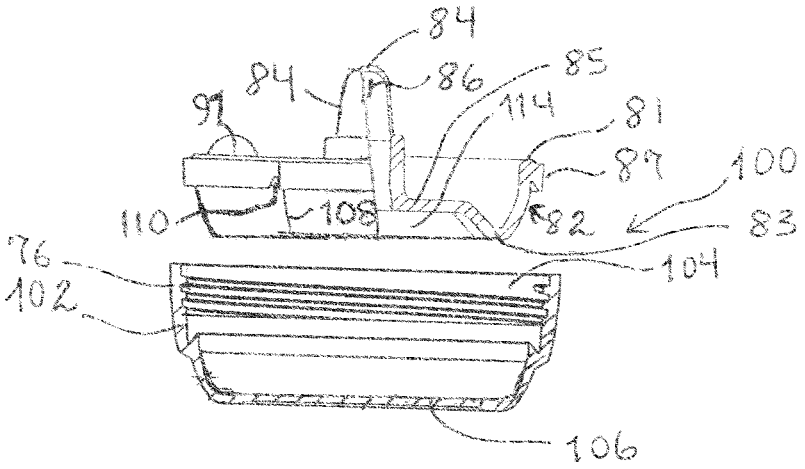
FIG. 9*a* is a partially cut away exploded view of a vent system according to alternative embodiments of the invention.
Figure 9B:
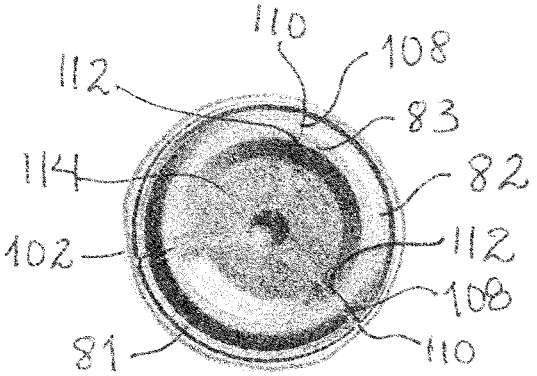
FIG. 9*b* is a bottom view of the vent system of FIG. 9*a*.

According to further embodiments of the invention, the sealing member 82 of FIG. 8*a* can be utilized together with a substantially flat closure member. As shown in FIGS. 9*a* and 9*b*, a partially cut away exploded and bottom view, respectively, of a vent system 100 according to alternative embodiments of the invention, a sealing member 82 sits inside the closure member 102. Closure member 102 has a top opening 104 and a flat bottom wall 106 designed to receive and support the U-shaped portion 83 of sealing member 82. Sealing member 82 is disposed on the flat bottom wall 106 of closure member 102 and lip 81 is pressed by the closure member against the rim of the bottom opening of the bottle to seal the bottom opening. It will be appreciated that the diameter of the sealing lip is wider at least than the inner walls of the rim of the bottle body so as to provide a liquid seal for the bottom of the bottle. Closure element 102 is preferably formed of material that is rigid, relative to the sealing member 82. During use of the vent system, the valve 84 protrudes into the bottle and ambient air can enter the interior of the bottle through bore 88.

In this case, the air conduits, formed from the vent grooves 108 in the sealing element, need not extend all the way to the bore 88. Rather, it is sufficient that they extend from openings 110 in the periphery of sealing member 82 through the bottom of the U-shaped portion 83 of the sealing element to openings 112 into a space 114, under the flat portion 85 of the sealing member 82 that is in operational communication with the bore. This space 114 is defined by the inner surface of the bottom wall of the closure member and the inner walls of the valve. In this way, they permit ambient air entering between the coupling means and complementary coupling means to pass between the sealing member and the closure member to space 114. Any vacuum inside the bottle will cause air from the space 114 to enter through the bore 88 and valve 84 into the interior of the bottle.

While each of the embodiments described above includes a single air passage bore, it will be appreciated that there can be more than one bore for air passage, each sealed by own one-way valve, or several bores sealed by a single one-way valve.

From the description above, it will be appreciated that the contact between the sealing member and the rim of the bottom opening seals the bottom opening of the container against the outflow of liquid. Because ambient air comes into the container from the side through the coupling elements, the air passage must be below or around this seal. As stated above, the air passage can be a conduit through the sealing member or closure member, or a groove in the sealing member closed by the closure member, or a groove in the closure member closed by the sealing member.

While the invention has been described hereinabove with particular reference to a baby bottle, by way of non-limiting example only, it will be appreciated that, alternatively, the vent system of the present invention can be utilized to close and seal the bottom opening of any other liquid container from which it is desired to dispense the liquid having a bottom opening. In this way, water bottles, soft drink bottles, liquid cleaning material containers and any other liquid containers that would benefit from venting to introduce ambient air can form the vented liquid container of the present invention, to permit ambient air to enter the container when vacuum is formed inside the container body.

While the vent system has been illustrated as round or circular in shape, it will be appreciated that the sealing member and the closure member can have any appropriate geometric shape as long as the sealing member is fitted in the closure element so as to seal the bottom opening of the container, and as long as the coupling elements are complementary to coupling elements on the container body.

It will be appreciated that holes in the bottom of the closure member are not required in any embodiment of the invention. In this way, the liquid container in general, and the baby bottle, in particular, of the present invention are less susceptible to dirt and germs coming into the container with the air than prior art bottles.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A vented liquid container comprising:

a container body with a top opening configured to accommodate a dispensing opening and an open-ended bottom portion having coupling elements at its bottom end;

a solid bottom closure member including a bottom portion and a peripheral side wall, the bottom portion and the side wall having no holes therein:

coupling elements extending from the side walls of the bottom closure member configured to engage the coupling elements on the bottom portion of the container body for closing the bottom opening of the container; and a sealing member disposed in the closure member, the sealing member including:

a sealing element configured to seal a rim of the container body bottom opening and having a bore selectively in communication with the interior of the body, and a one-way valve sealing the bore against liquid passage from the container and selectively permitting air passage through the bore into the container body;

wherein the coupling elements on the body, the sealing element and the closure member are configured to define an air passage between them through which ambient air can enter and pass from an upper end of the peripheral wall toward the bottom portion of the closure member; and an air conduit operatively coupled between the air passage and the bore.

2. The vented liquid container of claim 1, wherein the container is a baby bottle.

3. The vented liquid container according to claim 1, further comprising a stop element defined on an inside surface of the closure member cooperating with the sealing member for releasably retaining said sealing member in said closure member.

4. The vented liquid container according to claim 1, wherein the sealing member includes a tab for aid in removal of the sealing member from the closure member.

5. The vented liquid container according to claim 1, wherein the air conduit comprises at least one groove between the sealing member and the closure member.

6. The vented liquid container according to claim 1, wherein the air conduit comprises at least one tubular conduit or at least one groove in the sealing element.

7. The vented liquid container according to claim 1, wherein the complementary coupling elements between the bottom of the container body and the closure member are in a spaced relationship when the container is assembled, thereby defining the air passage.

8. The vented liquid container according to claim 7, wherein the coupling elements include notches that are aligned when the container is assembled, thereby defining a longitudinal air access slot that extends from the top of the closure member to a point in operative communication with the air conduit.

9. The vented liquid container according to claim 8, wherein the air conduit comprises at least one tubular conduit or at least one groove in the bottom portion of the closure member.

10. A sealing member for a vented liquid container, wherein the container is comprised of:

a body including a top opening configured to accommodate a dispensing element, coupling elements at a bottom end thereof, and an open bottom end, a solid closure member for the open bottom end of the body, the closure member including a bottom portion and a peripheral side wall, the bottom portion and the side wall having no holes therein; and coupling elements extending from the side wall of the closure member configured to engage the coupling elements on the bottom portion of the container body, wherein the coupling elements are configured to define an air passage between them when the container is assembled, the sealing member comprising:

a sealing element configured to be disposed in the bottom closure member and to seal a rim of the container bottom opening;

a bore selectively in communication with the interior of the container body;

a one-way valve sealing the bore against liquid passage from the container and selectively permitting air passage through the bore into the container; and an air conduit defined at least in part in at least part of the bottom surface of the sealing element, in communication with the air passage between the coupling elements and the bore when the container is assembled.

11. The sealing member according to claim 10, wherein the air conduit is defined by at least one channel in the bottom portion of the bottom closure member, and operatively coupled to the bottom surface of the sealing element when the container is assembled.

12. The sealing member according to claim 10, wherein the air conduit comprises at least one tubular conduit or at least one groove in the sealing element.

13. The sealing member according to claim 10, wherein the sealing member at least partially conforms in shape to the closure member in order to seal the container body bottom opening and to define in at least part of the bottom surface of the sealing element an air conduit between the air passage defined by the coupling elements and the space in operational communication with the bore.

14. The sealing member according to claim 10, wherein the sealing member includes a tab for aid in removal of the sealing member from the closure member.

* * * * *